US006777619B1

(12) United States Patent
Badinski et al.

(10) Patent No.: US 6,777,619 B1
(45) Date of Patent: Aug. 17, 2004

(54) ELECTRICAL CONNECTOR HAVING ENHANCED STRAIN RELIEF FOR SIGNAL-SENSITIVE ELECTRONIC EQUIPMENT

(75) Inventors: Curt Von Badinski, San Jose, CA (US); William Edwards, Livermore, CA (US); Michael Kornprobst, Pleasanton, CA (US); Bradley Erickson, San Carlos, CA (US); Samir Vasavda, Fremont, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/358,744

(22) Filed: Feb. 4, 2003

(51) Int. Cl.[7] ..... H01R 13/622
(52) U.S. Cl. ..... 174/135; 439/362
(58) Field of Search ..... 174/135; 439/362

(56) References Cited

U.S. PATENT DOCUMENTS

| | | | | | |
|---|---|---|---|---|---|
| 2,215,713 | A | * | 9/1940 | Peck | 439/362 |
| 3,718,887 | A | * | 2/1973 | Solomon et al. | 439/362 |
| 4,564,256 | A | * | 1/1986 | Damiano et al. | 439/362 |
| 4,767,350 | A | * | 8/1988 | Cooper et al. | 439/362 |
| 5,426,567 | A | * | 6/1995 | Opeka | 439/362 |
| 5,622,524 | A | * | 4/1997 | Dirmeyer | 439/620 |
| 6,198,625 | B1 | * | 3/2001 | Leman | 361/681 |
| 6,346,676 | B1 | * | 2/2002 | Caldwell | 174/117 F |
| 6,428,355 | B1 | * | 8/2002 | Machado | 439/578 |
| 6,481,409 | B1 | * | 11/2002 | Wade et al. | 123/198 F |
| 6,582,244 | B2 | * | 6/2003 | Fogg et al. | 439/362 |
| 6,652,325 | B2 | * | 11/2003 | Tharp et al. | 439/660 |

OTHER PUBLICATIONS

Unknown author/source; copies of 2 digital images of what is believed to be a power connector housing; first recieved by an Inventor/Applicant, after date of conception, on Sep. 17, 2002, with allegation from source that item in images were used by Digital Equipment Corporation around 1988; viewed and received by Applicants' representative on Jan. 24, 2003, 2 pages.

Molex, "0.80 mm (0.031") Pitch Ultra+™ VHDCI Connector System," 2002, 2 pages.

Selwyn Electronics, "Cable–to–Board Connectors, VHDCI Connectors," undated , 1 page.

* cited by examiner

*Primary Examiner*—Dean A. Reichard
*Assistant Examiner*—Adolfo Nino
(74) *Attorney, Agent, or Firm*—Hickman Palermo Truong & Becker LLP

(57) ABSTRACT

An electrical connector comprises a housing configured to house an interconnect mechanism, which defines an on-axis plane that is coplanar with the long axis of the interconnect mechanism. The housing includes at least two receptacles for accepting coupling mechanisms for interconnecting the connector to an electronic component. The centerline axis of at least one of the receptacles is parallel to the on-axis plane and offset from the on-axis plane. In one embodiment, the housing further comprises a first lip having a long axis that is parallel with the on-axis plane, such that when the connector is interconnected to an electronic component, the first lip applies an off-axis force to the component. The off-axis force is applied to the component along a first off-axis that is different than the on-axis. Consequently, resistance to deflection of the connector is provided, as is a more reliable contact engagement between the connector and the interconnected electronic component.

17 Claims, 4 Drawing Sheets

ELECTRICAL CONNECTOR HAVING ENHANCED STRAIN RELIEF FOR SIGNAL-SENSITIVE ELECTRONIC EQUIPMENT

FIELD OF THE INVENTION

The present invention generally relates to electrical connectors. The invention relates more specifically to an electrical connector having enhanced strain relief for signal-sensitive electronic equipment.

BACKGROUND OF THE INVENTION

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

Very High Density Cable Interconnect

The Small Computer System Interfaces (SCSI) were originally developed as a set of ANSI standard electronic interfaces to allow personal computers to communicate with peripheral hardware such as disk drives, tape drives, CD-ROM drives, printers, and scanners faster and more flexibly than previous interfaces. The original SCSI is now known as SCSI-1, which evolved into SCSI-2.

SCSI-3 consists of a set of primary commands and additional specialized command sets to meet the needs of specific device types. For example, the collection of SCSI-3 command sets is used not only for the SCSI-3 parallel interface but for additional parallel and serial protocols, including Fibre Channel, Serial Bus Protocol (used with the IEEE 1394 Fire Wire physical protocol), and the Serial Storage Protocol (SSP). The SCSI-3 protocol was designed to provide an efficient peer-to-peer I/O bus. Generally, the SCSI Parallel Interface (SPI) standards define the mechanical, electrical, timing and protocol requirements of the SCSI parallel interface to allow conforming SCSI devices to interoperate.

Connectors are the physical devices that are used to attach a SCSI cable to a SCSI device. Several different types of SCSI connectors are used to construct SCSI cables. SPI-2 defines a smaller version of an older high-density 68-pin connector. The desire for miniaturization and high throughput have been a driving force in the creation of new connector types.

The Very High Density Cable Interconnect (VHDCI) was introduced in the SPI-2 standard. VHDCI connectors evolved from the computer industry, mainly for disk drive interconnections, which are primarily internal to a chassis and therefore are protected. Networking implementations of VHDCI connectors, such as with high-speed, high-volume switching components, are subject to different demands than are connectors implemented for disk drives. For example, disk drives can tolerate a certain amount of signal interruption and lost bits of information, because the drive can simply and quickly re-read the relevant portion of disk without a noticeable impact to the user. However, in high speed switch implementations, often, no signal interruption is tolerable.

VHDCI connectors are blade connectors having two rows of flat contacts instead of pins. Thus, VHDCI connectors have a high pin density per unit length and good electrical characteristics at high throughputs. Consequently, VHDCI connectors are often used for implementations with electronic components that require high throughput and that have marginal space available on their interconnect panels. However, pin contacts are more physically compliant, thus, connectors with pins are generally considered to be more tolerant of misalignment than blade connectors.

Industry standard VHDCI connectors that are available are considered structurally weak. In particular, they are susceptible to off-axis forces. Off-axis forces are those that are not on the axis of the jackscrews (often referred to as thumbscrews). In fact, an industry-standard VHDCI connector has been measured to lose contact between some of the male and female connector contacts with a deflection of 0.065 inches at 1 inch away from the chassis to which it is connected. Consequently, electrical signals traveling through the connector can be interrupted.

Losing connector contact is an unacceptable situation with certain electronic components. If a signal interruption occurs with some electronic components, at a minimum, critical data is lost. In some instances, such as with high-speed network switches, the component typically crashes, thus requiring a subsequent reboot. A reboot operation often can last on the order of two minutes, which is unacceptable downtime for the switch fabric. Hence, such electronic components are considered to tolerate no signal interruption whatsoever. Indeed, the specification for a popular VHDCI connector allows for 1 $\mu$sec (microsecond) of signal interruption. However, even this duration of signal interruption is considered unacceptable for certain electronic components.

One prior approach to overcoming the structural weakness inherent to conventional VHDCI connectors is to install a retrofit bracket to provide more rigidity to the connector. However, retrofitting components that are already provisioned in the field is not a desirable or practical solution.

Based on the foregoing, there is a clear need for an improved electrical connector for signal-sensitive electronic equipment. In this context, signal-sensitivity refers to the equipment's tolerance to signal interruption. Further, there is a specific need for such a connector in the context of a low-profile Very High Density Cable Interconnect.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1:
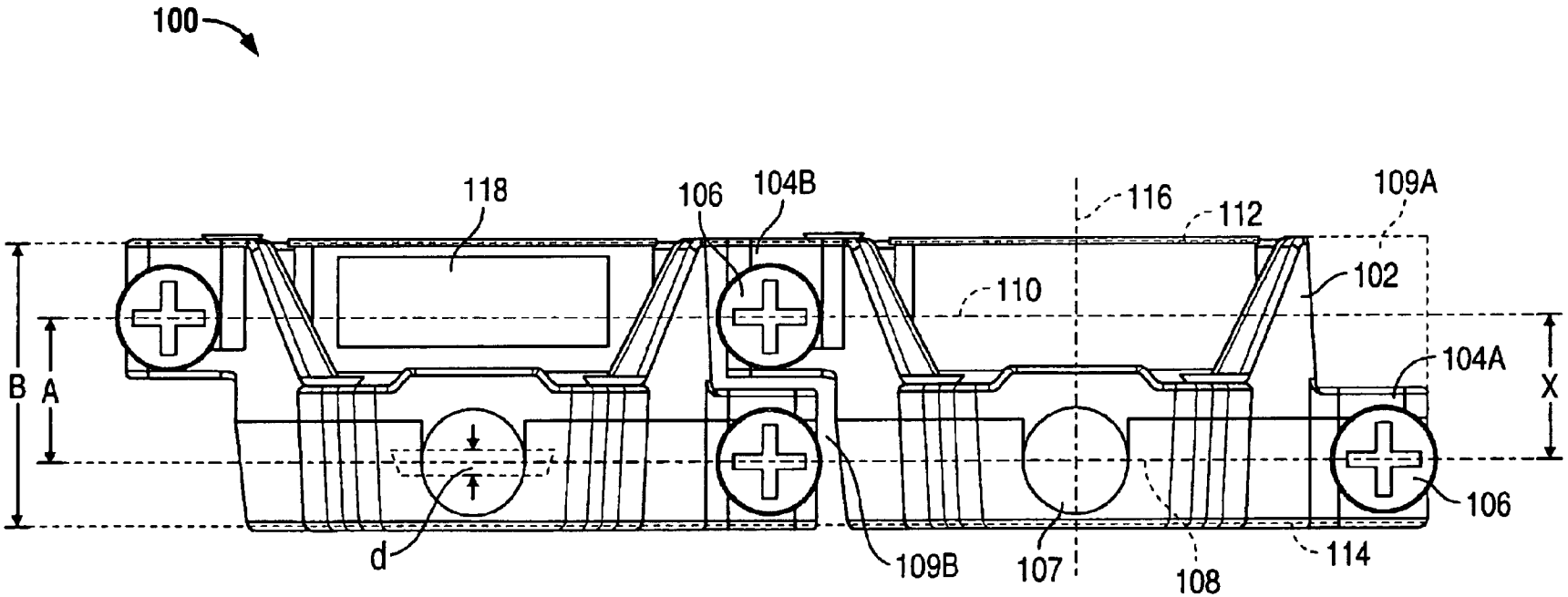
FIG. 1 is a rear view of a plurality of electrical connectors.

An electrical connector having enhanced strain relief for signal-sensitive electronic equipment is described. In this context, signal-sensitivity refers to the equipment's tolerance to signal interruption. In other words, a signal-sensitive component is not tolerant of electrical signal interruption. A component could be considered signal-sensitive, or not tolerant to signal interruption, based on numerous factors. Non-limiting examples include: the impact that a signal interruption has on the component (e.g., it requires a reboot of the component), the amount of time it takes to recover from a signal interruption, the criticality of the component in its environment (e.g., level of redundancy in the system, effect on the operation of the system), etc., to name a few.

In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Overview

Signal-sensitive electronic equipment is also considered to be sensitive to connector deflection. That is, deflection of an electrical connector when experiencing various external forces affects its ability to maintain contact with its mating interconnect contacts, and therefore, to maintain uninterrupted signal throughput. An improved electrical connector as described herein is resistant to external forces that might cause deflection of the interconnect and that might cause consequent loss of electrical contact and resulting signal interruption to the electronic equipment to which it is coupled.

In one aspect, an electrical connector that comprises a housing configured to house an interconnect mechanism, such as a blade connector. The interconnect mechanism defines an on-axis plane that is coplanar with the long axis of the interconnect mechanism. The housing includes at least two receptacles for accepting coupling mechanisms, such as thumbscrews, for interconnecting the connector to an electronic component. Significantly, the centerline axis of at least one of the receptacles is parallel to the on-axis plane and offset from the on-axis plane. Hence, with a given force applied to the connector, deflection of the connector is reduced, as is the probability of resultant signal interruption to the component.

In an embodiment, the housing further comprises a first lip. The first lip has a long axis that is parallel with the on-axis plane, such that when the connector is interconnected to an electronic component, the first lip applies an off-axis force to the component. The off-axis force is applied to the component along a first off-axis that is different than the on-axis.

Furthermore, in an embodiment, the housing further comprises a second lip that has a long axis parallel with the on-axis plane. The second lip applies a separate off-axis force to the component along a second off-axis that is different than the on-axis and different than the first off-axis. Hence, reactive forces from the component chassis are localized in the off-axis areas, away from the on-axis which is coincident with the connector mechanism. Consequently, both resistance to deflection of the connector and more reliable contact engagement between the connector and the interconnected electronic component are provided.

Improved Electrical Connector

FIG. 1 is a rear view of a plurality of electrical connectors 100, in accordance with an embodiment.

Electrical connector 100 comprises a housing 102, configured to house an electrical interconnect mechanism (not shown). In an embodiment, the electrical interconnect mechanism is a conventional blade connector, with rows of flat electrical contacts. In another embodiment, the interconnect mechanism is a VHDCI connector. In a related embodiment, the interconnect mechanism is a 68 position VHDCI connector.

Housing 102 of connector 100 further comprises at least two receptacles 104A, 104B for accepting coupling mechanisms 106. For example, coupling mechanism 106 may be a conventional jackscrew or thumbscrew. In one embodiment, a larger screw is used than with typical industry-standard electrical connectors. In such an implementation, a #6 screw is used, which has 32 threads per inch. Coupling mechanism 106 is used to couple the connector 100 to an electronic device. Any suitable coupling mechanism may be used, including screw mechanisms.

Also depicted in FIG. 1 is an on-axis 108. Typically, in reference to electrical connectors, an on-axis is defined by an axis intersecting the centerlines of the thumbscrews or thumbscrew receptacles. Herein, the on-axis 108 is defined by an on-axis plane that is substantially coplanar with a long axis of the interconnect mechanism. Another way of defining the on-axis is an axis that is substantially coplanar with a plane passing through an approximate centerline of receptacle 104A and a centerline of cable cut-out 107, since the centerline of cable cut-out 107 is coincident with the long axis of the interconnect mechanism.

Other pertinent axes are depicted in FIG. 1 for reference. Off-axis 110 is an axis in a plane that is substantially parallel to the on-axis plane and coincident with an approximate centerline of receptacle 104B. Off-axis 112 is coincident with a first lip 202 of FIG. 2. Off-axis 112 is in a plane that is substantially parallel to the on-axis plane and to off-axis 110. Off-axis 114 is coincident with a second lip 204 of FIG. 2. Off-axis 114 is in a plane that is substantially parallel to the on-axis plane and to off-axes 110 and 112.

Significantly, receptacle 104B is offset from the on-axis 108. In other words, a centerline axis of receptacle 104B is parallel to and offset from the on-axis 108. Hence, receptacles 104A, 104B do not lie in a plane with the on-axis 108. An arrangement of attach points for interconnecting the connector 100 with an electronic component, such as those coincident with coupling mechanisms 106 and receptacles 104A, 104B, provides more mechanical stability and rigidity.

When an external force is applied to connector 100 or an attached cable, such as when a user simply bumps or pulls on the cable, the reactive forces from the interconnected chassis, which are induced due to the applied external force, are larger than they would be with a conventional arrangement of on-axis attach point receptacles. That is, the reactive moment is larger due to the distance X(FIG. 1) between axis 110, which is coincident with receptacle 104B, and the on-axis 108, which is coincident with the interconnect mechanism which comprises the electrical contacts. Therefore, the likelihood of contact disengagement and consequent signal interruption is significantly reduced in relation to connectors with attach points in line with the on-axis.

Testing of a connector with a configuration such as described herein for connector 100 have shown deflections, for example, on the order of 0.02 inch to 0.03 inch deflection at 1 inch away from the chassis to which it is connected, in comparison with 0.065 inch deflection for conventional connector configurations. Such an order of magnitude of deflection with respect to connector 100 was not enough to open the connector, i.e., to lose contact. Hence, electronic component signal traffic is not likely to be interrupted with a bump or jarring of the connector 100. Connector 100 is not limited to any specific maximum or minimum amount of deflection when a given force is applied.

As depicted in FIG. 1, receptacle 104B extends outwardly away from a vertical centerline axis 116 of connector 100. Vertical axis 116 is perpendicular to the long axis of the interconnect mechanism and is, therefore, perpendicular to on-axis 108 and off-axes 110, 112 and 114. Further, receptacle 104B is adjacent to a first cut-out 109B from housing 102. The first cut-out 109B is intersected by on-axis 108. Therefore, as depicted in FIG. 1, cut-out 109B is below receptacle 104B.

Receptacle 104A also extends outwardly away from vertical axis 116, in a direction opposing the extension direction of receptacle 104B. Similarly to receptacle 104B, receptacle 104A is adjacent to a second cut-out 109A from housing 102. The second cut-out 109A is intersected by the horizontal centerline of receptacle 104B, that is, by axis 110. Therefore, as depicted in FIG. 1, cut-out 109A is above receptacle 104A.

The configuration of connector 100 provides for use of a plurality of connectors 100 in a side-by-side configuration as shown in FIG. 1, with an optimized or reduced overall installation footprint for the plurality of connectors. Often, VHDCI connectors are chosen for particular applications not only for their throughput capability, but also for their compactness, or small footprint. The configuration of connector 100 allows side-by-side installation of more connectors 100 per unit length or width of chassis than do prior conventional, or industry-standard, connectors.

In one embodiment, connector 100 comprises a window 118. Window 118 is a cut-out from housing 102. At least a portion of the interconnect mechanism, e.g., a blade connector, is viewable through window 118. Hence, window 118 is beneficial during the process of connecting the connector 100 with an electronic component because a user can view the mating connectors.

Blade interconnect mechanisms are not flat, rather the electrical contact configuration has a two-dimensional cross section. In other words, blade connectors have a certain dimension, d (FIG. 1), in a direction perpendicular to the long axis of the interconnect mechanism. With reference to dimension B, which is the distance between off-axis 112 and off-axis 114 of connector 100, in one embodiment the following ratio limitation is preferable: $2<B/d<8.75$. In addition, with further reference to dimension A, which is the distance between off-axis 110 and on-axis 108 of connector 100, in one embodiment the following ratio limitation is preferable: $0<A/B<0.41$.

Figure 2:
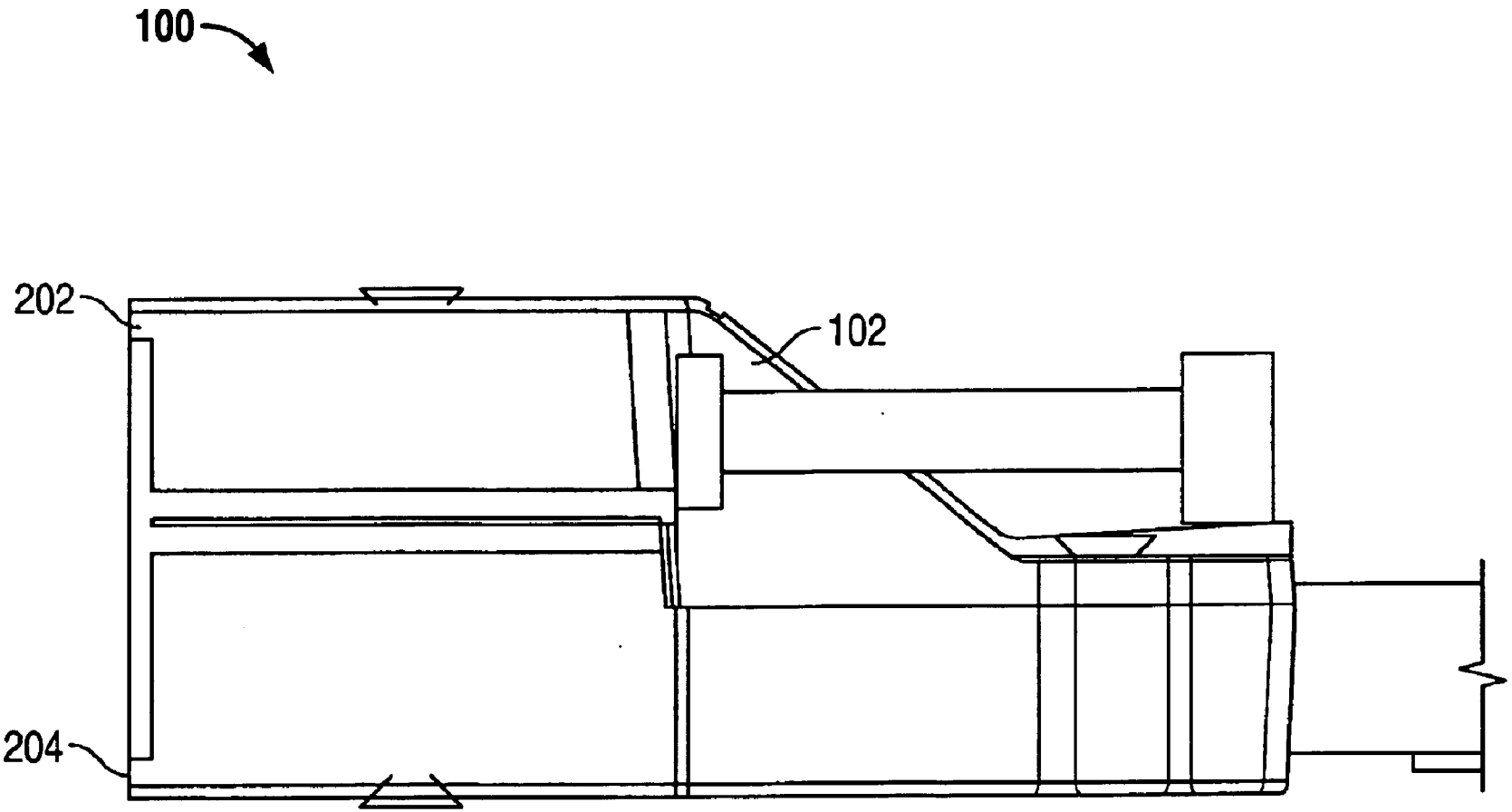
FIG. 2 is a simplified partial cut-away left side view of an electrical connector.
Figure 3:
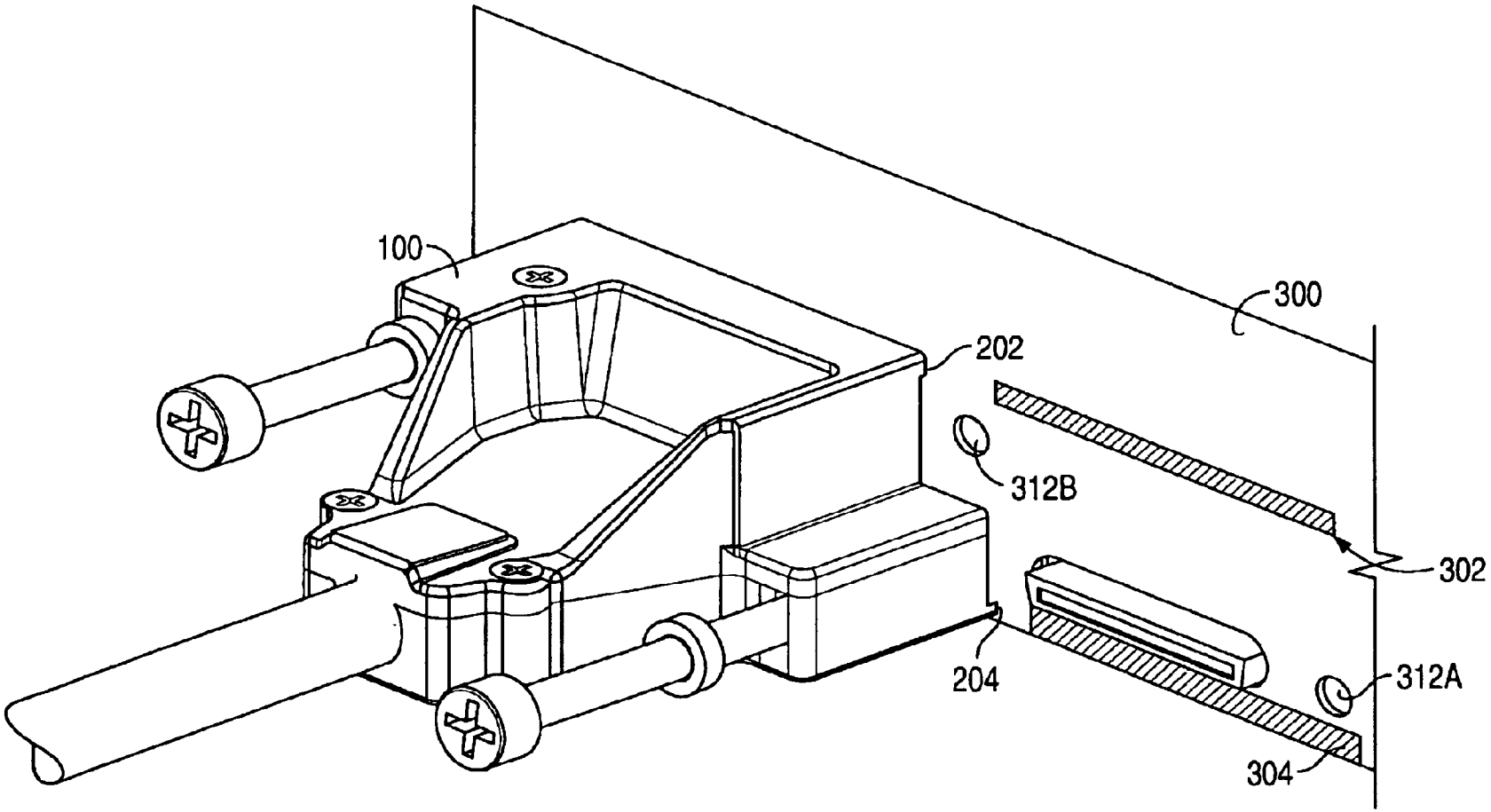
FIG. 3 is an isometric view of an electrical connector and a coupled chassis.

FIG. 2 is a simplified partial cut-away left side view of electrical connector 100. Housing 102 of connector 100 further comprises, in one embodiment, a first lip 202 that extends along the width of the upper front edge of housing 102. Lip 202 comprises a projecting edge of housing 102, as depicted in FIG. 2 and FIG. 3. The long axis of the lip 202 is parallel with the on-axis 108 (FIG. 1) and coincident with off-axis 112 (FIG. 1). First lip 202 is configured to apply a first off-axis force to an electronic device to which the connector 100 is coupled. Lip 202 applies the first off-axis force locally and substantially linearly along a portion of off-axis 112, which, as described, is different than on-axis 108.

Furthermore, housing 102 of connector 100 comprises, in one embodiment, a second lip 204 that extends along the width of the lower front edge of housing 102. Lip 204 comprises a projecting edge of housing 102, as depicted in FIG. 2 and FIG. 3. The long axis of the lip 204 is parallel with the on-axis 108 (FIG. 1) and coincident with off-axis 114 (FIG. 1). Second lip is configured to apply a second off-axis force to an electronic device to which the connector 100 is coupled. Lip 204 applies the second off-axis force locally and substantially linearly along a portion of off-axis 114, which, as described, is different than on-axis 108 and different than off-axis 112.

FIG. 3 is an isometric view of electrical connector 100 and a coupled chassis 300. FIG. 3 further illustrates first lip 202 and second lip 204 of connector 100.

Additionally, FIG. 3 includes a chassis 300 of an electronic component. As an example, chassis 300 is a signal-sensitive high speed Ethernet switching device, to which a connector 100 is coupled. Chassis 300 includes a first coupling receptacle 312B and a second coupling receptacle 312A, illustrating an example of the installation or coupling pattern for connector 100. To couple connector 100 to chassis 300, coupling mechanisms 106 (FIG. 1) are inserted through receptacles 104A, 104B of the connector 100, and into coupling receptacles 312A, 312B of the chassis. Coupling receptacles 312A, 312B can be implemented as a conventional threaded female-type receptacle, for receiving coupling mechanisms 106.

Depicted on chassis 300 are two force areas 302 and 304. Force area 302 is the approximate area to which a first lip 202 of a connector 100 applies the first off-axis force. Furthermore, force area 304 is the approximate area to which a second lip 204 of a connector 100 applies the second off-axis force. The first and second off-axis forces, when applied by a connector 100 coupled to a chassis 300, pre-load the chassis at the extremities illustrated as force areas 302 and 304, thus providing more resistance to deflection or other motion of connector 100 in relation to chassis 300. Hence, the unique configuration of connector 100, when coupled to a chassis 300, minimizes the contact surface area (e.g., force areas 302, 304) from the coupling of connector 100 and chassis 300, and increases the offset of the contact surface area from the on-axis 108 (FIG. 1), thereby providing a more mechanically rigid coupling. A more rigid coupling reduces the probability of a decoupling of the connector 100 from the chassis 300, thus reducing the probability of a signal interruption through connector 100.

In an embodiment, chassis 300 is reinforced to provide further mechanical strength to a coupling of connector 100 and chassis 300. For example, chassis 300 may be configured with a reinforcement plate or sheet, preferably substantially local to the areas depicted as force areas 302, 304.

Figure 4:
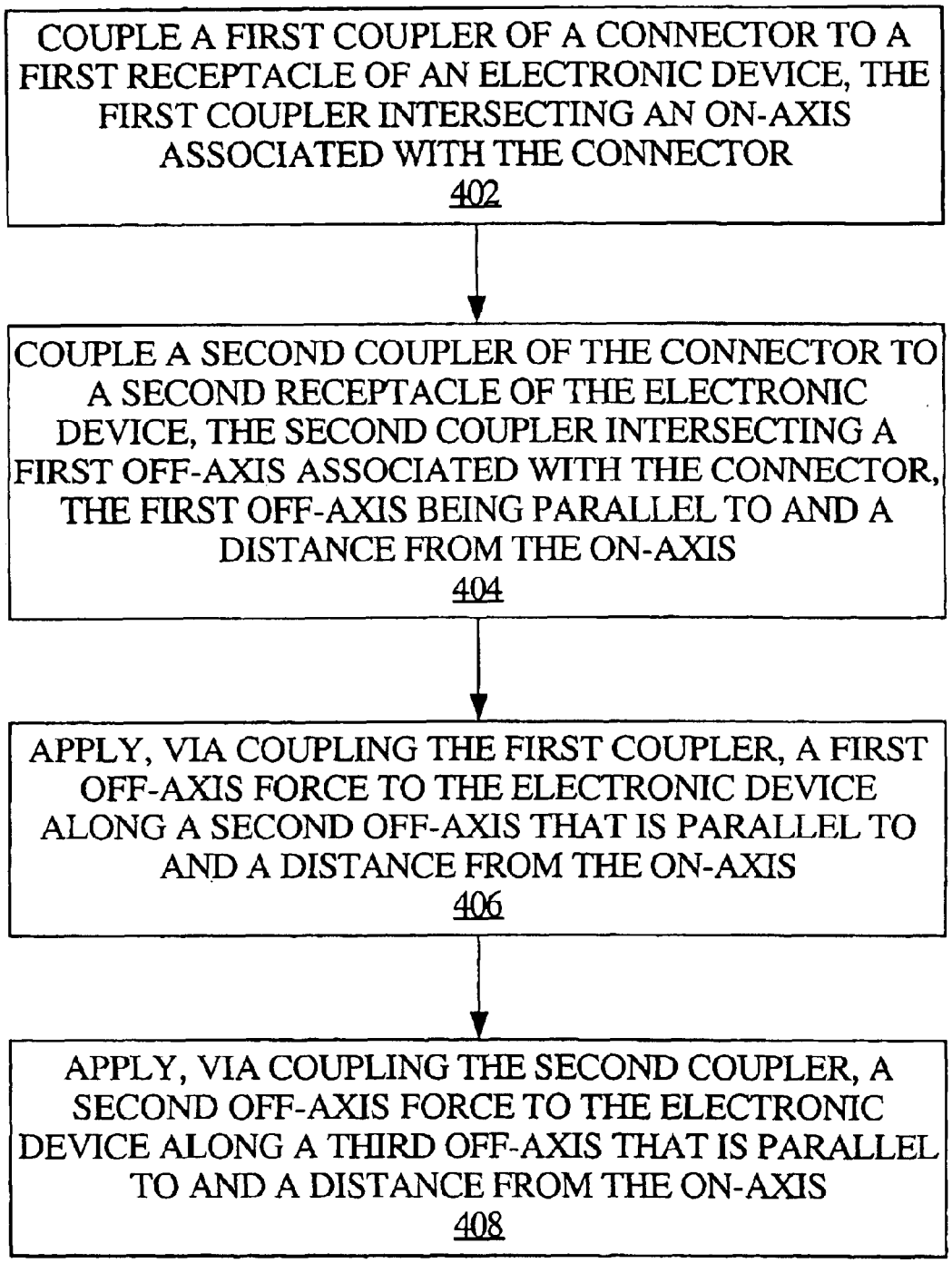
FIG. 4 is a flow diagram illustrating a process for coupling an electrical connector to an electronic device.

Process for Coupling an Electrical Connector with a Signal-Sensitive Electronic Device FIG. 4 is a flow diagram illustrating a process for coupling an electrical connector to an electronic device.

At block 402, a first coupler of a connector, such as connector 100 (FIG. 1), is coupled to a first receptacle of an electronic device, such as coupling receptacle 312A (FIG. 3). The first coupler intersects an on-axis associated with the connector, such as on-axis 108 (FIG. 1) of connector 100.

At block 404, a second coupler of the connector is coupled to a second receptacle of the electronic device, such as coupling receptacle 312B (FIG. 3). The second coupler intersects a first off-axis associated with the connector, such as off-axis 110 (FIG. 1) of connector 100.

In an embodiment, at optional block 406, a first off-axis force is applied to the electronic device along a second off-axis that is parallel to and a distance from the on-axis, via the step of coupling the first coupler (block 402). For example, the first off-axis force is applied along off-axis 114 (FIG. 1) of connector 100.

In an embodiment, at optional block 408, a second off-axis force is applied to the electronic device along a third off-axis that is parallel to and a distance from the on-axis, via the step of coupling the second coupler (block 404). For example, the second off-axis force is applied along off-axis 112 (FIG. 1) of connector 100.

Coupling a connector to an electronic device with a coupler along an off-axis of the connector provides a mechanically rigid coupling that is resistant to deflection and therefore resistant to signal interruptions with respect to the coupling of the connector and the electronic device. Additionally, applying localized off-axis forces, which are parallel to the on-axis, to the electronic device further contributes to a mechanically rigid coupling that is resistant to deflection.

Extensions and Alternatives

In the foregoing specification, the invention has been described with reference to specific embodiments thereof. It will, however, be evident that various modifications and changes may be made thereto without departing from the broader spirit and scope of the invention. For example, although benefits of using a connector as described herein are presented in a context with a signal-sensitive electronic component, similar benefits are also provided to use with non-signal-sensitive components. For another example, benefits are described herein with specific reference to VHDCI connectors, however, using an apparatus as described herein with other high-data-rate electrical connectors, perhaps those not yet developed, is specifically considered. The specification and drawings are, accordingly, to be regarded in an illustrative rather than a restrictive sense.

In addition, in this description certain process steps are set forth in a particular order, and alphabetic and alphanumeric labels may be used to identify certain steps. Unless specifically stated in the description, embodiments of the invention are not necessarily limited to any particular order of carrying out such steps. In particular, the labels are used merely for convenient identification of steps, and are not intended to specify or require a particular order of carrying out such steps.

What is claimed is:

1. An electrical interconnect apparatus, comprising:

a housing that houses an electrical interconnect mechanism that defines an on-axis plane that is substantially coplanar with a long axis of the interconnect mechanism, wherein the electrical interconnect mechanism provides a high rate of data throughput, the housing comprising a first lip that forms a projecting edge of the housing and that has a long axis that is substantially parallel with the on-axis plane;

wherein when the apparatus is interconnected to an electronic device, the first lip contacts and applies a first off-axis force to the electronic device that is localized near where the first lip contacts the electronic device;

at least two receptacles in the housing, which accept coupling mechanisms that interconnect the apparatus to an electronic device;

wherein an off-axis that intersects a first receptacle of the at least two receptacles is substantially parallel to the on-axis plane and offset from the on-axis plane.

2. The apparatus of claim 1, wherein the electrical interconnect mechanism is a Very High Density Cable Interconnect mechanism.

3. The apparatus of claim 1, wherein the housing further includes:

a second lip that forms a projecting edge of the housing and that has a long axis that is substantially parallel with the on-axis plane;

wherein when the apparatus is interconnected to the electronic device, the second lip contacts and applies a second off-axis force to the electronic device that is localized near where the second lip contacts the electronic device.

4. The apparatus of claim 3, wherein a distance, in a direction perpendicular to the on-axis plane, between the off-axis that intersects the first receptacle and an on-axis that lies in the on-axis plane, divided by a distance between the long axis of the first lip and the long axis of the second lip, is less than 0.41.

5. The apparatus of claim 1, wherein an axis that intersects a second receptacle of the at least two receptacles is substantially coplanar with the on-axis plane, and wherein the second receptacle is different than the first receptacle.

6. The apparatus of claim 5, wherein the first receptacle extends outwardly away from a vertical axis that is perpendicular to and intersects the long axis of the interconnect mechanism; and wherein the first receptacle is adjacent to a first cut-out from the housing;

wherein the first cut-out is intersected by the long axis of the interconnect mechanism;

wherein the second receptacle extends outwardly away from the vertical axis that is perpendicular to and intersects the long axis of the interconnect mechanism, in an opposing direction to the first receptacle; and wherein the second receptacle is adjacent to a second cut-out from the housing, the second cut-out being intersected by the off-axis that intersects the first receptacle.

7. The apparatus of claim 1, wherein the housing comprises:

a window through which the electrical interconnect mechanism is visible.

8. The apparatus of claim 1, wherein the interconnect mechanism is a blade connector.

9. The apparatus of claim 1, further comprising:

an electronic device chassis having means for receiving the coupling mechanisms for coupling the apparatus to the electronic device.

10. The apparatus of claim 1, wherein the at least two receptacles comprise only two receptacles.

11. A method for coupling an electrical connector to an electronic device, the method comprising the steps of:

coupling a first coupler of the connector to a first receptacle of the electronic device, the first coupler intersecting an on-axis associated with the connector; and coupling a second coupler of the connector to a second receptacle of the electronic device, the second coupler intersecting a first off-axis associated with the connector, the first off-axis being substantially parallel to the on-axis and a distance from the on-axis;

wherein the steps of coupling the first and second couplers comprise applying a first off-axis force to the electronic device that is localized near where a first lip that forms a projecting edge of the connector contacts the electronic device along a second off-axis that is substantially parallel to the on-axis and a distance from the on-axis.

12. The method of claim 11, further comprising the step of:

viewing an interconnect mechanism of the connector through a cut-out of the connector.

13. The method of claim 11, wherein the steps of coupling the first and second couplers includes coupling the first and second couplers to a signal-sensitive electronic device.

14. The method of claim 13, wherein a distance between the first off-axis and the on-axis, divided by a distance between the second off-axis and the third off-axis, is less than 0.41.

15. The method of claim 13, wherein the steps of coupling the first and second couplers includes applying a second off-axis force to the electronic device along a third off-axis that is substantially parallel to the on-axis and a distance from the on-axis.

16. An apparatus for transmitting non-power electrical signals to a signal-sensitive electronic device, the apparatus comprising:

means for coupling a first coupler to a first receptacle of the electronic device, the first coupler intersecting an on-axis associated with the apparatus; and means for coupling a second coupler to a second receptacle of the electronic device, the second coupler intersecting a first off-axis of the apparatus, the first off-axis being substantially parallel to the on-axis and a distance from the on-axis;

means for applying a first off-axis force to the electronic device that is localized along a second off-axis that is substantially parallel to the on-axis and a distance from the on-axis.

17. The apparatus of claim 16, wherein the means for coupling a first coupler, the means for coupling a second coupler and the means for applying a first off-axis force to the electronic device includes means for coupling a first coupler, means for coupling a second coupler and means for applying a first off-axis force, respectively, to a signal-sensitive electronic device.

* * * * *